US008382604B2

(12) United States Patent
Billings

(10) Patent No.: US 8,382,604 B2
(45) Date of Patent: Feb. 26, 2013

(54) MODULAR HOSEL, WEIGHT-ADJUSTABLE GOLF CLUB HEAD ASSEMBLY

(75) Inventor: David P. Billings, McKinney, TX (US)

(73) Assignee: Dogleg Right Corporation, Plano, TX (US)

( * ) Notice: Subject to any disclaimer, the term of this patent is extended or adjusted under 35 U.S.C. 154(b) by 0 days.

(21) Appl. No.: 12/437,905

(22) Filed: May 8, 2009

(65) Prior Publication Data

US 2009/0247319 A1 Oct. 1, 2009

Related U.S. Application Data

(63) Continuation of application No. 11/467,160, filed on Aug. 24, 2006, now Pat. No. 7,566,276.

(51) Int. Cl.
*A63B 69/36* (2006.01)
*A63B 53/04* (2006.01)
*A63B 53/06* (2006.01)

(52) U.S. Cl. ..... 473/244; 473/248; 473/251; 473/252; 473/288; 473/334; 473/338; 473/340; 473/341; 473/349

(58) Field of Classification Search ..... 473/287–292, 473/324–350, 244–248, 251, 252; D21/736–746
See application file for complete search history.

(56) References Cited

U.S. PATENT DOCUMENTS

| | | | | |
|---|---|---|---|---|
| 1,167,106 | A | 1/1916 | Palmer | |
| 1,213,382 | A | 1/1917 | Kent | |
| 1,320,163 | A * | 10/1919 | Maurice | 473/335 |
| 1,453,503 | A | 5/1923 | Holmes | |
| 1,518,316 | A | 12/1924 | Ellingham | |
| 1,526,438 | A | 2/1925 | Scott | |
| 1,538,312 | A | 5/1925 | Beat | |
| 1,568,888 | A | 1/1926 | Dunn | |
| 1,756,219 | A | 4/1930 | Spiker | |
| 1,868,286 | A | 7/1932 | Grieve | |
| 1,965,954 | A | 7/1934 | Davis | |
| 2,067,556 | A | 1/1937 | Wettlaufer | |
| 2,163,091 | A | 6/1939 | Held | |
| 2,171,383 | A | 8/1939 | Wettlaufer | |
| 2,198,981 | A | 4/1940 | Sullivan | |
| 2,214,356 | A | 9/1940 | Wettlaufer | |

(Continued)

FOREIGN PATENT DOCUMENTS

| | | | |
|---|---|---|---|
| JP | H6-126004 | A | 5/1994 |
| JP | H7-15067 | A | 3/1995 |

(Continued)

OTHER PUBLICATIONS

Edwin Watts Golf, Fathers Day 2003 catalog, p. 40.

(Continued)

*Primary Examiner* — Sebastiano Passaniti
(74) *Attorney, Agent, or Firm* — David H. Judson

(57) ABSTRACT

A golf putter head with a front portion comprising traditional shape and appearance, with an integral face insert extending through the head to an alignment and weighting portion extending beyond the main body of the putter, adding improved alignment, increased MOI and adjustable weighting and adjustable balance and optimizable Center of Percussion. The putter head comprises a central face insert portion extending through the body and above the traditional weight flange, with mass relieved portions below the top of the alignment piece in order to receive one or more optional weights, and the upper side of the rearwardly extending portion being engraved or marked with various alignment indicia, and the whole through-head insert face portion and rearwardly extending portion being affixed to the base portion of the head at least in part with threaded fasteners.

12 Claims, 7 Drawing Sheets

U.S. PATENT DOCUMENTS

| | | | | | |
|---|---|---|---|---|---|
| 2,225,930 | A | | 12/1940 | Sexton | |
| 2,328,583 | A | | 9/1943 | Reach | |
| 2,332,342 | A | | 10/1943 | Reach | |
| 2,460,445 | A | | 2/1949 | Bigler | |
| 2,503,506 | A | | 4/1950 | Miller | |
| 2,998,254 | A | | 8/1961 | Rains et al. | |
| 3,075,768 | A | | 1/1963 | Karns | |
| 3,143,349 | A | | 8/1964 | MacIntyre | |
| 3,419,275 | A | * | 12/1968 | Winkleman | 473/335 |
| 3,466,047 | A | | 9/1969 | Rodia et al. | |
| 3,606,327 | A | | 9/1971 | Gorman | |
| 3,610,630 | A | | 10/1971 | Glover | |
| 3,652,094 | A | | 3/1972 | Glover | |
| 3,680,868 | A | | 8/1972 | Jacob | |
| 3,749,408 | A | | 7/1973 | Mills | |
| 3,817,534 | A | * | 6/1974 | Carlino | 473/337 |
| 3,897,066 | A | | 7/1975 | Belmont | |
| 3,976,299 | A | | 8/1976 | Lawrence | |
| 3,979,123 | A | | 9/1976 | Belmont | |
| 4,008,896 | A | | 2/1977 | Gordos | |
| 4,043,563 | A | * | 8/1977 | Churchward | 473/338 |
| 4,052,075 | A | | 10/1977 | Daly | |
| 4,085,934 | A | | 4/1978 | Churchward | |
| 4,121,832 | A | * | 10/1978 | Ebbing | 473/335 |
| 4,180,269 | A | | 12/1979 | Thompson | |
| 4,214,754 | A | | 7/1980 | Zebelean | |
| 4,325,553 | A | | 4/1982 | Taylor | |
| 4,340,230 | A | | 7/1982 | Churchward | |
| 4,417,731 | A | | 11/1983 | Yamada | |
| 4,423,874 | A | | 1/1984 | Stuff, Jr. | |
| 4,432,549 | A | | 2/1984 | Zebelean | |
| 4,502,687 | A | | 3/1985 | Kochevar | |
| 4,607,846 | A | | 8/1986 | Perkins | |
| 4,645,207 | A | * | 2/1987 | Teramoto et al. | 473/290 |
| 4,655,459 | A | | 4/1987 | Antonious | |
| 4,695,054 | A | | 9/1987 | Tunstall | |
| 4,754,976 | A | | 7/1988 | Pelz | |
| 4,754,977 | A | | 7/1988 | Sahm | |
| 4,811,950 | A | | 3/1989 | Kobayashi | |
| 4,824,116 | A | | 4/1989 | Nagamoto et al. | |
| 4,828,266 | A | | 5/1989 | Tunstall | |
| 4,867,458 | A | | 9/1989 | Sumikawa et al. | |
| 4,869,507 | A | | 9/1989 | Sahm | |
| 4,895,371 | A | | 1/1990 | Bushner | |
| 4,927,144 | A | | 5/1990 | Stormon | |
| 4,944,515 | A | | 7/1990 | Shearer | |
| 5,013,041 | A | | 5/1991 | Sun et al. | |
| 5,046,740 | A | | 9/1991 | D'Eath | |
| 5,050,879 | A | | 9/1991 | Sun et al. | |
| 5,056,705 | A | | 10/1991 | Wakita et al. | |
| 5,058,895 | A | | 10/1991 | Igarashi | |
| 5,064,197 | A | | 11/1991 | Eddy | |
| 5,078,400 | A | | 1/1992 | Desboilles et al. | |
| 5,080,365 | A | | 1/1992 | Winchell | |
| 5,082,278 | A | | 1/1992 | Hsien | |
| 5,184,823 | A | | 2/1993 | Desboilles et al. | |
| 5,193,806 | A | | 3/1993 | Burkly | |
| 5,219,408 | A | | 6/1993 | Sun | |
| 5,244,210 | A | | 9/1993 | Au | |
| 5,273,283 | A | | 12/1993 | Bowland | |
| 5,289,865 | A | | 3/1994 | Sun | |
| 5,316,298 | A | | 5/1994 | Hutin et al. | |
| 5,316,305 | A | | 5/1994 | McCabe et al. | |
| 5,322,285 | A | | 6/1994 | Turner | |
| 5,351,958 | A | | 10/1994 | Helmstetter | |
| 5,385,348 | A | | 1/1995 | Wargo | |
| 5,407,202 | A | | 4/1995 | Igarashi | |
| 5,421,577 | A | * | 6/1995 | Kobayashi | 473/335 |
| 5,447,309 | A | | 9/1995 | Vincent | |
| 5,482,282 | A | | 1/1996 | Willis | |
| 5,494,282 | A | | 2/1996 | Pranio | |
| 5,518,243 | A | | 5/1996 | Redman | |
| 5,522,593 | A | | 6/1996 | Kobayashi et al. | |
| 5,527,034 | A | | 6/1996 | Ashcraft et al. | |
| 5,533,730 | A | | 7/1996 | Ruvang | |
| 5,558,226 | A | | 9/1996 | Fritz | |
| 5,570,886 | A | | 11/1996 | Rigal et al. | |
| 5,582,553 | A | | 12/1996 | Ashcraft et al. | |
| 5,637,044 | A | | 6/1997 | Swash | |
| 5,690,562 | A | | 11/1997 | Sturm | |
| 5,746,664 | A | | 5/1998 | Reynolds, Jr. | |
| 5,755,624 | A | | 5/1998 | Helmstetter | |
| 5,766,092 | A | | 6/1998 | Mimeur et al. | |
| 5,788,584 | A | | 8/1998 | Parente et al. | |
| 5,797,807 | A | | 8/1998 | Moore | |
| 5,851,160 | A | | 12/1998 | Rugge et al. | |
| 5,855,525 | A | | 1/1999 | Turner | |
| 5,911,638 | A | | 6/1999 | Parente et al. | |
| 5,913,735 | A | | 6/1999 | Kenmi | |
| 5,921,871 | A | | 7/1999 | Fisher | |
| 5,944,619 | A | | 8/1999 | Cameron | |
| 5,947,840 | A | | 9/1999 | Ryan | |
| 5,961,394 | A | | 10/1999 | Minabe | |
| 5,993,324 | A | | 11/1999 | Gammil | |
| 6,001,024 | A | | 12/1999 | Van Alen, II et al. | |
| 6,015,354 | A | | 1/2000 | Ahn et al. | |
| 6,030,295 | A | | 2/2000 | Takeda | |
| 6,089,994 | A | | 7/2000 | Sun | |
| 6,206,790 | B1 | | 3/2001 | Kubica et al. | |
| 6,224,497 | B1 | | 5/2001 | Antonious | |
| 6,227,986 | B1 | | 5/2001 | Fisher | |
| 6,238,302 | B1 | | 5/2001 | Helmstetter et al. | |
| 6,244,972 | B1 | | 6/2001 | Drossos | |
| 6,248,025 | B1 | | 6/2001 | Murphy et al. | |
| 6,254,494 | B1 | | 7/2001 | Hasebe et al. | |
| 6,273,831 | B1 | | 8/2001 | Dewanjee | |
| 6,290,609 | B1 | | 9/2001 | Takeda | |
| 6,306,048 | B1 | | 10/2001 | McCabe et al. | |
| 6,309,311 | B1 | | 10/2001 | Lu | |
| 6,315,678 | B1 | | 11/2001 | Teramoto | |
| 6,328,661 | B1 | | 12/2001 | Helmstetter | |
| 6,336,869 | B1 | | 1/2002 | Hettinger | |
| 6,354,962 | B1 | | 3/2002 | Galloway et al. | |
| 6,364,788 | B1 | | 4/2002 | Helmstetter et al. | |
| 6,443,851 | B1 | | 9/2002 | Liberatore | |
| 6,458,044 | B1 | * | 10/2002 | Vincent et al. | 473/334 |
| 6,478,694 | B2 | | 11/2002 | Anderson et al. | |
| 6,485,375 | B1 | * | 11/2002 | McKinley | 473/245 |
| 6,491,592 | B2 | | 12/2002 | Cackett | |
| 6,514,154 | B1 | | 2/2003 | Finn | |
| 6,530,848 | B2 | | 3/2003 | Gillig | |
| 6,592,468 | B2 | * | 7/2003 | Vincent et al. | 473/334 |
| 6,641,487 | B1 | * | 11/2003 | Hamburger | 473/288 |
| 6,648,772 | B2 | | 11/2003 | Vincent et al. | |
| 6,659,883 | B2 | * | 12/2003 | Nelson et al. | 473/324 |
| 6,663,497 | B2 | | 12/2003 | Cameron | |
| 6,716,111 | B2 | | 4/2004 | Liberatore | |
| 6,739,983 | B2 | | 5/2004 | Helmstetter et al. | |
| D502,233 | S | | 2/2005 | Grace | |
| D502,234 | S | | 2/2005 | Grace | |
| D502,236 | S | | 2/2005 | Grace | |
| 6,863,620 | B2 | | 3/2005 | Tucker, Sr. | |
| 6,899,636 | B2 | | 5/2005 | Finn | |
| 6,902,495 | B2 | | 6/2005 | Pergande et al. | |
| 6,923,734 | B2 | | 8/2005 | Meyer | |
| 6,926,619 | B2 | | 8/2005 | Helmstetter et al. | |
| 6,929,564 | B2 | | 8/2005 | Olsavsky et al. | |
| 6,958,019 | B2 | | 10/2005 | Rohrer | |
| 6,988,955 | B2 | | 1/2006 | Stoakes | |
| 6,988,960 | B2 | | 1/2006 | Mahaffey et al. | |
| 6,991,558 | B2 | | 1/2006 | Beach et al. | |
| 7,004,852 | B2 | | 2/2006 | Billings | |
| 7,014,566 | B1 | | 3/2006 | Norvise | |
| 7,052,410 | B2 | | 5/2006 | Cameron | |
| 7,074,132 | B1 | | 7/2006 | Finn | |
| 7,077,758 | B2 | | 7/2006 | Rohrer | |
| 7,108,609 | B2 | | 9/2006 | Stites et al. | |
| 7,108,611 | B2 | * | 9/2006 | MacIlraith | 473/288 |
| 7,115,047 | B2 | | 10/2006 | Stevens et al. | |
| 7,121,955 | B2 | | 10/2006 | Stevens et al. | |
| 7,147,570 | B2 | | 12/2006 | Toulon et al. | |
| 7,147,573 | B2 | | 12/2006 | DiMarco | |
| 7,163,469 | B2 | | 1/2007 | Bonneau | |
| 7,166,039 | B2 | | 1/2007 | Hettinger et al. | |
| 7,166,041 | B2 | | 1/2007 | Evans | |
| 7,198,575 | B2 | | 4/2007 | Beach et al. | |
| 7,344,450 | B2 | | 3/2008 | Billings | |

| | | | | |
|---|---|---|---|---|
| 7,407,443 | B2 | 8/2008 | Franklin et al. | |
| 7,566,276 | B2 * | 7/2009 | Billings | 473/251 |
| 8,092,316 | B2 * | 1/2012 | Breier et al. | 473/244 |
| 2002/0065144 | A1 | 5/2002 | Helmstetter et al. | |
| 2002/0128089 | A1 | 9/2002 | Sillers et al. | |
| 2002/0137576 | A1 | 9/2002 | Dammen | |
| 2003/0130059 | A1 * | 7/2003 | Billings | 473/332 |
| 2003/0228925 | A1 | 12/2003 | Rohrer | |
| 2004/0063516 | A1 | 4/2004 | Cameron | |
| 2004/0116199 | A1 * | 6/2004 | Specht | 473/251 |
| 2005/0159235 | A1 * | 7/2005 | Gray | 473/288 |
| 2005/0159236 | A1 * | 7/2005 | Edel | 473/288 |
| 2005/0187028 | A1 | 8/2005 | Chang et al. | |
| 2006/0148585 | A1 | 7/2006 | Vinton | |
| 2006/0166757 | A1 | 7/2006 | Butler et al. | |
| 2007/0155524 | A1 | 7/2007 | Cameron | |
| 2009/0291772 | A1 * | 11/2009 | Boyd et al. | 473/291 |
| 2010/0041490 | A1 * | 2/2010 | Boyd et al. | 473/288 |

FOREIGN PATENT DOCUMENTS

| | | | |
|---|---|---|---|
| JP | H11-9742 | A | 1/1999 |
| JP | 2000-24149 | A | 1/2000 |
| WO | WO 01/66199 | A1 | 9/2001 |

OTHER PUBLICATIONS

Complaint Against TaylorMade Golf Company Inc.; Dogleg Right Partners LP, Dogleg Right Corporation; Civil Action No. 2:07-CV-533-TJW/CE; Dec. 7, 2007.
Taylor Made'S Answer to Complaint for Patent Infringement, Counterclaim Against Dogleg; Taylor Made Golf Company; Civil Action No. 2:07-CV-533-TJW/CE; Jan. 25, 2008.
Answer to Taylor Made'S Counterclaims; Dogleg Right Partners, LP, Dogleg Right Corporation; Civil Action No. 2:07-CV-533-TJW/CE; Feb. 14, 2008.
Motion to Amend Pleadings; Dogleg Right Partners LP, Dogleg Right Corporation; Civil Action No. 2:07-CV-533-TJW/CE; Mar. 28, 2008.
Amended Complaint Against Taylor Made Golf Company Inc.; Dogleg Right Partners LP, Dogleg Right Corporation; Civil Action No. 2:07-CV-533-TJW/CE; Aug. 26, 2008.
Request for Inter Partes Reexamination of 7,004,852 with Notice of Litigation and Supplemental Information Disclosure Statement Mar. 24, 2008.
Reexamination Control No. 95/000,631; Order Granting Inter Partes Reexamination of US Pat. No. 7,004,852 and First Office Action; Jun. 19, 2008.
Reexamination Control No. 95/000,631; Patent Owner's Response to Office Action; Sep. 19, 2008.
Reexamination Control No. 95/000,631; Third Party Response; Oct. 20, 2008.
Request for Inter Partes Reexamination of 7,189,169 with Notice of Litigation and Supplemental Information Disclosure Statement Mar. 24, 2008.
Reexamination Control No. 95/000,632; Order Granting Inter Partes Reexamination of US Pat. No. 7,189,169 and First Office Action; Jun. 19, 2008.
Reexamination Control No. 95/000,632; Patent Owner's Response to Office Action; Sep. 19, 2008.
Reexamination Control No. 95/000,632; Third Party Response; Oct. 20, 2008.
Request for Reexamination of 7,344,450 with Notice of Litigation and Supplemental Information Disclosure Statement; Jun. 19, 2008.
Reexamination Control No. 95/000,378; PTO Decision Vacating Filing Date of Inter Partes Reexamination of US Pat. No. 7,344,450; Sep. 4, 2008.
Reexamination Control No. 95/000,378; Corrected Request for Inter Partes Reexamination of U.S. Patent No. 7,344,450, Oct. 6, 2008.
Reexamination Control No. 95/000,378; Order Granting Inter Partes Reexamination of US Pat. No. 7,344,450 and First Office Action; Mar. 25, 2009.
Reexamination Control No. 95/000,378; Office Action; Mar. 25, 2009.
U.S. Appl. No. 10/043,421; Office Action with Notice of References Cited; Nov. 1, 2002.
U.S. Appl. No. 10/043,421; Amendment in response to Office Action; May 6, 2003.
U.S. Appl. No. 10/043,421; Office Action (Final); Jul. 24, 2003.
U.S. Appl. No. 10/043,421; Amendment After Final with RCE; Jan. 5, 2004.
U.S. Appl. No. 10/043,421; Office Action with Notice of References Cited; Feb. 12, 2004.
U.S. Appl. No. 10/043,421; Amendment in response to Office Action; Jul. 15, 2004.
U.S. Appl. No. 10/043,421; Office Action (Final) with Notice of References Cited; Nov. 18, 2004.
U.S. Appl. No. 10/043,421; Amendment After Final with RCE; Apr. 22, 2005.
U.S. Appl. No. 10/043,421; Office Action; May 20, 2005.
U.S. Appl. No. 10/043,421; Amendment in response to Office Action; Sep. 12, 2005.
U S. Appl. No. 11/313,137; Petition to Make Special with IDS; Feb. 20, 2006.
U.S. Appl. No. 11/313,137; Office Action with Notice of References Cited; Jul. 14, 2006.
U.S. Appl. No. 11/313,137; Proposed Amendment; Aug. 11, 2006.
U.S. Appl. No. 11/313,137; Interview Summary; Aug. 16, 2006.
U.S. Appl. No. 11/313,137; Amendment in Response to Office Action; Aug. 15, 2006.
U.S. Appl. No. 11/313,137; Office Action; Oct. 31, 2006.
U.S. Appl. No. 11/313,137; Amendment in Response to Office Action; Nov. 29, 2006.
U.S. Appl. No. 11/313,137; Notice of Allowance and Examiner's Interview Summary; Dec. 15, 2006.
U.S. Appl. No. 11/467,136; Petition to Make Special with IDS; Aug. 24, 2006.
U.S. Appl. No. 11/467,136; Office Action with Notice of References Cited; May 29, 2007.
U.S. Appl. No. 11/467,136; Amendment in Response to Office Action; Nov. 29, 2007.
U.S. Appl. No. 11/467,136; Supplemental Amendment; Dec. 13, 2007.
U.S. Appl. No. 11/467,136; Notice of Allowance and Examiner's Interview Summary; Jan. 11, 2008.
U.S. Appl. No. 11/467,139; Petition to Make Special with IDS; Aug. 24, 2006.
U.S. Appl. No. 11/467,139; Office Action with Notice of References Cited; Feb. 27, 2007.
U.S. Appl. No. 11/467,139; Amendment in Response to Office Action; Aug. 27, 2007.
U.S. Appl. No. 11/467,139; Office Action; Nov. 16, 2007.
U.S. Appl. No. 11/467,139; Amendment I Response to Office Action; Apr. 16, 2008.
U.S. Appl. No. 11/467,139; Office Action; Aug. 4, 2008.
U.S. Appl. No. 11/467,139; Amendment in Response to Office Action; Dec. 4, 2008.
U.S. Appl. No. 11/467,139; Office Action; Feb. 26, 2009.
U.S. Appl. No. 11/467,142; Petition to Make Special with Information Disclosure Statement; Aug. 24, 2006.
U.S. Appl. No. 11/467,142; Decision on Petition to Make Special; Dec. 14, 2006.
U.S. Appl. No. 11/467,142; Office Action; Mar. 8, 2007.
U.S. Appl. No. 11/467,142; Amendment in Response to Office Action; Sep. 10, 2007.
U.S. Appl. No. 11/467,142; Information Disclosure Statement; Sep. 10, 2007.
U.S. Appl. No. 11/467,142; Office Action (Final); Nov. 21, 2007.
U.S. Appl. No. 11/467,142; Amendment in Response to Office Action with RCE; May 21, 2008.
U.S. Appl. No. 11/467,142; Information Disclosure Statement; May 21, 2008.
U.S. Appl. No. 11/467,142; Office Action; Aug. 4, 2008.
U.S. Appl. No. 11/467,142; Amendment in Response to Office Action; Feb. 4, 2009.
U.S. Appl. No. 11/467,142; Office Action; Apr. 15, 2009.

* cited by examiner

FIG. 9
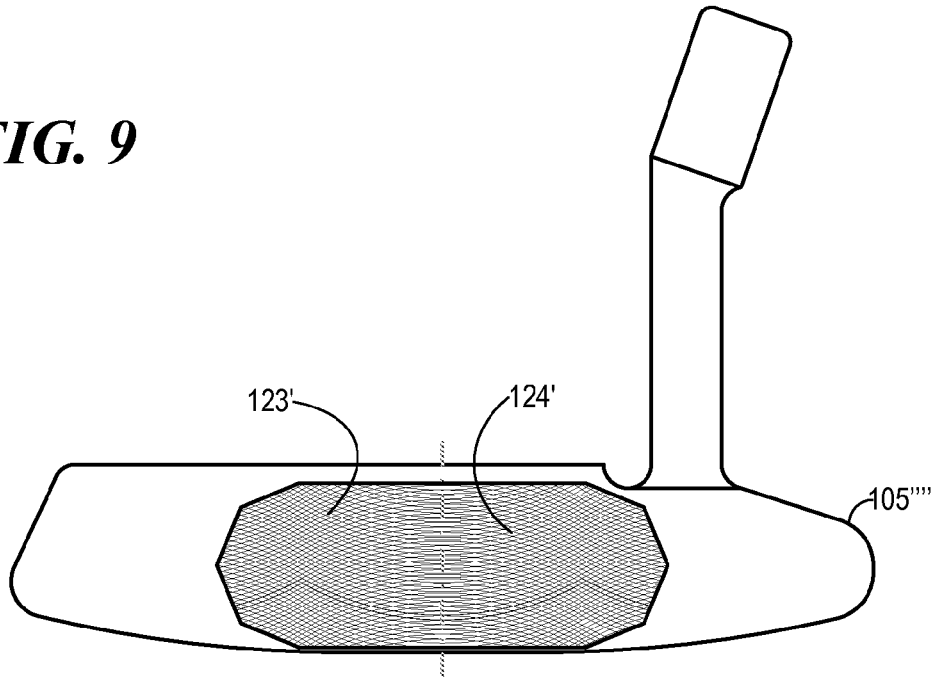
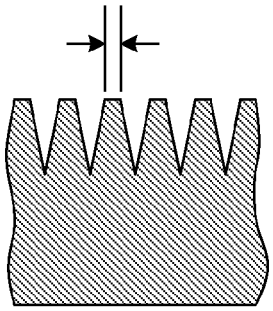
FIG. 10A
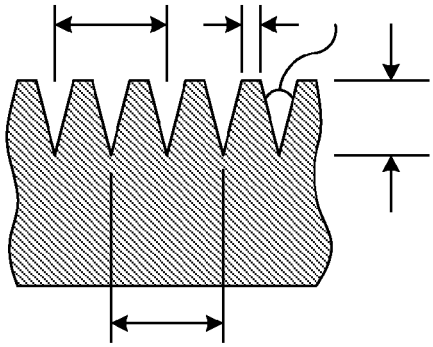
FIG. 10B

MODULAR HOSEL, WEIGHT-ADJUSTABLE GOLF CLUB HEAD ASSEMBLY

CROSS-REFERENCE TO RELATED APPLICATIONS

This application is a continuation of, and claims the benefit of the filing date of, U.S. patent application Ser. No. 11/467,160 entitled "Multi-Piece Putter Head Having an Insert", filed Aug. 24, 2006 now U.S. Pat. No. 7,566,276.

BACKGROUND OF THE INVENTION

1. Field of the Invention

The invention relates generally to golf clubs and, more particularly, to putter heads.

2. Description of Related Art

In recent years, a great amount of attention has been given by golf club designers, engineers, and manufacturers towards moving the weight and the center of gravity (CG) towards the polar extremes, increasing the moment of inertia (MOI) of the putter head, so that the putter twists less on off-center hits and therefore is more forgiving and more accurate on miss-hits. Such polar weighted putter heads increase the effective hitting area, commonly referred to as the "sweet spot," and, therefore, are more forgiving on miss hits where the golf ball is not struck in the center of the clubface.

Various manufacturing techniques have been attempted to achieve a golf club possessing the above features, i.e., increasing the size of the MOI and the sweet spot or effective hitting area. These techniques have included placing dense weight in the polar extremes of the heel and toe of a blade-type putter, which are generally narrow from face to back. However, blade-type putter heads are not as forgiving or have as high a MOI as mallet type putters, whose large mass and rearward CG makes them more forgiving.

The mallet-type head geometry usually provides for a larger head and larger footprint than that of a blade-type putter, and much of the mass is spread out throughout the area of the head. Such large mallet heads are not visually appealing to many golfers who prefer blade-type putters.

Also, depending on the placement of, and type of hosel or shaft connection, including how much offset and where the hosel or shaft is connected, as well as variables with the user's stroke mechanics, these large mallet heads can be awkward to swing and rotate properly in concert with the elliptical path of the stroke plane. Too large an amount of mass in an aft-back location, too far away from the axis of the shaft can cause many golfers to have to overly manipulate the putter to maintain a proper face to plane relationship, or cause the putter to be pushed off the stroke plane on the backstroke. This in turn can negatively affect the resultant forward stroke, the position and alignment of the putter head at contact, and therefore the accuracy and consistency of the results with such a putter design.

It should be noted that the weight and balance specifications and requirements of each putter are as individual as the style and specifications of the golfers themselves.

Blade putters, including cavity back flange type putters and thin or half-mallets, are generally easier for more golfers to swing correctly on a stroke plane without unwanted manipulation, because the mass and center of gravity of the club head are usually positioned more proximate to the axis of the shaft. Therefore, many golfers are more comfortable with, have more experience with and are more confident using blade-type putters, even though the deeper CG and higher MOI of a mallet-type putter is often more forgiving. However, blade type putters generally have very short sighting lines due to their thin width face to back, and therefore are not as easy to align as larger mallets that contain longer sight lines or other indicia.

Furthermore, it is known that many golfers get tired of their putter when their performance with it is less than desirable. Switching to a new putter often brings more success, at least initially, as the golfer tends to concentrate more and use new neural pathways to perform the stroke. It is believed that the new sensations, including optical sensations, play a role in the player's performing better with the new putter. However, it is proven that most golfers putt better when their putter is properly fit for all their physical properties of length, lie, loft, offset, weight of the individual components, grip style and size and the like.

Blade-type putters are also usually limited in the amount of weight that can be placed in the head due to their dense, thin structures. Placing additional weights onto these heads, such as in the cavity, on the heel or toe or soles can negatively affect the appearance, balance and CG and performance of the putter. Lead weight strips can also be dislodged through use and from interference with the other clubs in the bag when so exposed on the exterior surfaces.

Other prior art teaches attachment of appendages to aid in alignment. However, the governing bodies have rules prohibiting any "attachments to the head," other than lead tape, which is grandfathered in as traditional. These rules have allowed multi-piece heads, so long as all the pieces are fixed. It is commonly understood that weights, such as screws and the like, are allowable as long as they are affixed "into" the head, versus "onto" the head.

None of the known prior art teaches the ability or a mechanism to fit or customize the Center of Gravity of a traditionally styled putter head, within the rules of golf, to suit an individual golfer's stroke mechanics and the resultant dynamic center of percussion, nor the ability to customize the length, shape or alignment indicia of a back-weight member to suit an individual golfer's preferences and needs for alignment shape and indicia.

In one prior art attempt to make a putter that achieves some of these desired advantages, a multi-piece putter head was provided having a putter head portion with an opening from front to back, and having a through-head insert having a front face for striking the ball and a rear portion extending through the opening rearwardly. In this prior attempt, however, the insert was retained solely by means of an interference fit between the through-head insert and the opening through the putter head portion and thus could be dislodged by rough handling or some conditions of play. (Although the insert can generally have an oval shape, rather than round, this interference fit can be regarded as causing the putter head portion to impose a force on the insert that is generally parallel to the striking face of the through-head insert and generally inwardly oriented.)

This means of securing the through-head insert in the putter head portion has disadvantages. The amount of the interference fit force is very sensitive to small changes in dimension of the through-head insert, the putter head portion and its opening, thus making it difficult to manufacture the multi-piece putter consistently with the same interference fit force between the through-head insert and the putter head portion in all putters under all conditions. Thus, in some cases, it is possible that the force will be insufficient to hold the parts together if the putter head is dropped or otherwise roughly handled, for example, or to avoid undesirable relative vibration between through-head insert and the putter head portion under all playing conditions. Furthermore, it is possible that the interference force can also tend to bow out the striking face to a small degree, which could interfere with manufacturing procedures as well as risking changing the flatness of the striking face.

OBJECTS OF THE INVENTION

Therefore, there is a need for a more forgiving putter with a large moment of inertia that is more traditional looking than most large mallet-style heads, and also swings more like a blade putter for improved ergonomic stroke mechanics, has increased confidence through familiar and pleasing design and optics, improved alignment, and improved energy transfer and ball launch and roll performance.

There is also a need for a golf club head with a traditional appearance, improved alignment features selectable by the user according to his or her tastes, including their needs for a new appearance, improved polar weighting and increased MOI, and means for selectively back-weighting while positively affecting the weight, balance, launch and roll dynamics.

SUMMARY OF THE INVENTION

In one embodiment, a multi-piece putter head is provided comprising: a first putter head portion having a front face positioned to strike a golf ball, a back, a sole and an opening above the sole encompassing a centrally located area of the front face, the opening extending through the head portion from the front face to the back of the head portion; an insert member having a rear portion extending rearwardly through the opening of the putter head portion and rearward of the back of the head portion, the insert member having a front portion having a front face forming at least a portion of a surface for striking a golf ball; and the insert member being secured to the putter head at least in part by a securing device other than solely an interference fit.

The present invention provides a multi-piece golf club head that can have a traditional blade-type base head portion, with an insert into the face that extends through an opening to the back of the putter, and a rearwardly extending portion extending behind the back of the base portion, which can include thereon an alignment aid and indicia by its shape and markings, and improved weight distribution. The rearwardly extending portion provides improved back-weighting, an increased area for hidden weight adjustment, and improved alignment through the shape of the rearwardly extending portion and the longer space for providing alignment indicia.

The face insert portion and the rearwardly extending portion can be of integral construction or can be formed of separate pieces, secured together. For purposes of this application, by "integral" is meant that the parts are relatively permanently connected such that they are not separable without some damage, including, for example, one-piece construction or parts welded or parts epoxied together, but excluding a mere interference fit.

The base head portion can be fabricated similarly to a traditional blade-type putter head, preferably in denser weight material than the face insert and/or rearwardly extending portion of the through-head insert such as steel, and can include toe and heel weighting. The through-head insert, can be lightweight or lower density material and can be inserted and at least partially held in place by a press fit or other interference fit so that the striking face of the insert is flush mounted with the remaining striking face of the base putter head. However, to avoid or minimize disadvantages from relying solely on interference fit forces for retaining the through-head insert in place on the putter head portion, in the present invention, the through-head insert is retained at least in part by means other than an interference fit. These other means can include use of epoxy, and also can employ mechanical securing members such as threaded fasteners.

Threaded fasteners are advantageous for retaining the through-head insert in place for a number of reasons, including that the force applied by threaded fasteners can be large, and can be easily controlled during manufacturing. This makes it easier to ensure that the through-head insert and the putter head portion are securely held together under all conditions of use and play, minimizing the chance for the through-head insert to loosen due to rough handling or to have undesirable relative vibration between the through-head insert and the putter head portion during some playing conditions. Furthermore, although the threaded fasteners can be installed in a variety of positions, including above or below the insert, in one embodiment, the fasteners can be positioned such that they are generally perpendicular with the striking face, preferably entering from behind the striking face. This position for the fasteners also orients the force between the through-head insert and the putter head portion such that the force is generally perpendicular to the striking face; generally aligned with the direction of the putting stroke. This is believed to be advantageous in creating compressive stresses in the club face to resist impact forces upon striking the ball. This is also believed to assist in reducing the potential for bowing of the striking face of the through-head insert, caused by a high degree of interference force between them that might be caused if an interference fit alone was relied upon for securing the through-head insert to the base head portion.

BRIEF DESCRIPTION OF THE DRAWINGS

For a more complete understanding of the present invention, and the advantages thereof, reference is now made to the following description taken in conjunction with the accompanying drawings, in which:

FIG. 9 illustrates a view of the face of a left-handed putter head that embodies the present invention, with two spaced-apart leading edge arcuate grooves and two intersecting spaced-apart trailing edge arcuate grooves;

FIG. 10A is a vertical cross section through the face nearer the heel or toe of a vertically milled face that embodies the present invention, showing one example of the leading and trailing edge grooves as they would appear nearer the heel or toe of the face mill pattern, where the grooves are spaced closer together than the grooves in the middle of the face; and FIG. 10B is a vertical cross section through the middle of the face of a vertically milled face that embodies the present invention, showing one example of the leading and trailing edge grooves as they would appear in the middle of the face.

DETAILED DESCRIPTION

Figure 1:
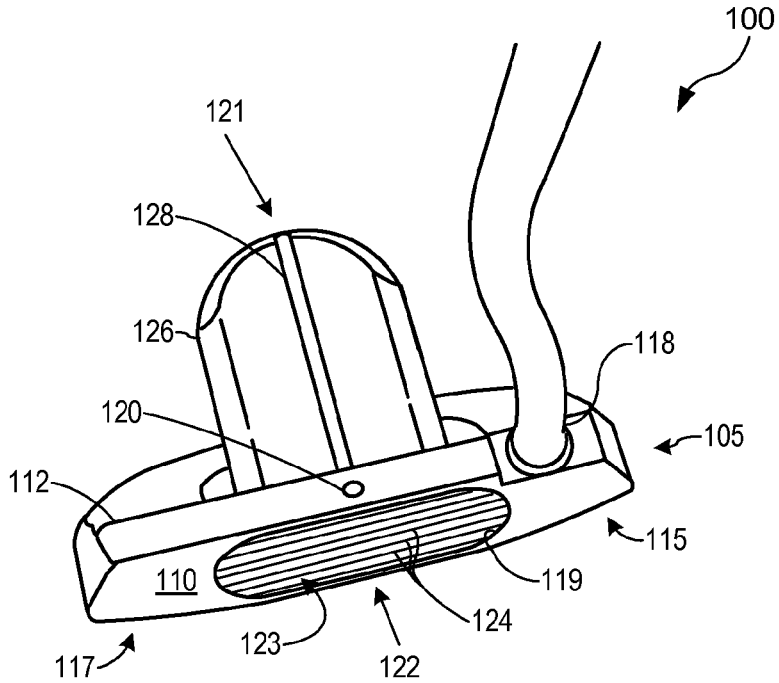
FIG. 1 illustrates a golf club putter head having a through-head insert, shown from the front of the head, that embodies features of the present invention.

Referring to FIG. 1 of the drawings, the reference numeral 100 generally designates a golf club head embodying features of the present invention. The golf club head 100 may generally comprise a base head portion 105 having a face portion 110, a top-line portion 112, a heel portion 115, a toe portion 117 and a hosel portion 118. The golf club head 100 is shown in a generally finished state and includes an optional alignment mark 120. In this embodiment, the face portion 110 has an opening 119 through it, which opening 119 includes a through-head insert 121, which includes a front insert portion 122 that is preferably inserted flush with the surrounding face 110, and can be at least partially retained in place by a press-fit or other interference fit, but also in addition or in lieu thereof by other securing means. Through-head insert 121 includes a rearwardly extending portion 126 extending beyond that back of base head portion 105, and can optionally include alignment indicia 128. The alignment indicia can be in the form of a CNC milled groove that is paint filled for easy viewing by the golfer, as depicted in FIG. 1. Alignment indicia 128 can also include an aligned row of holes, circles or indentations. Face insert portion 122 can have a striking face 123 that can be smooth, bead blasted, or can have optional grooves 124 and/or punch marks or the like.

The golf club head 100 in a finished state can be sanded, polished and plated as desired. In addition to the press-fit bond of the face insert and may be chamfered. The parts can also be joined by epoxy or the like, and any exposed grooves filled with paint, if desired. All parts can be CNC milled for precision for individual parts and for the press-fit interference bond, if used, and for consistency in production and for the straight lines that also aid alignment.

Figure 2A:
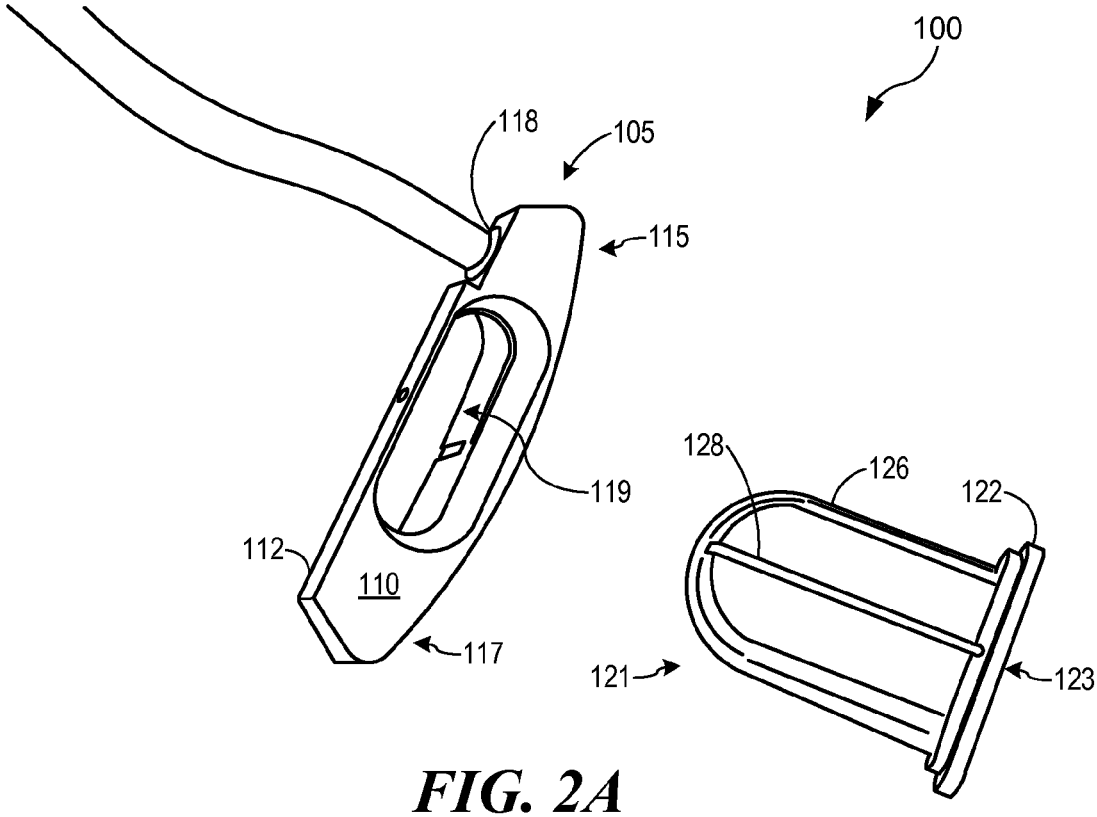
FIG. 2A illustrates an exploded view of a golf club putter head having a through-head insert, shown from the upper-rear of the head, that embodies features of the present invention.

FIG. 2A illustrates the golf club head 100 in an exploded view, after manufacturing the components and prior to assembly. The golf club head 100 generally comprises a base head portion 105 and a through-head insert 121. The base head portion 105 comprises the top-line portion 112, the heel portion 115, the toe portion 117, and opening 119 through the face 110 of the head first portion 105. The base head portion 105 can also include a hosel or shaft connection bore 118, and may be manufactured as a single piece. The opening 119 is sized and configured to receive the through-head insert 121, including a front insert portion 122 that is preferably inserted with its striking face flush with the surrounding face 110, and can be at least partially retained in place by a press-fit or other interference fit and, in addition to or in lieu thereof, by other securing means. The through-head insert 121 has a rearwardly extending portion 126 extending beyond the back of base head portion 105, which can provide back-weighting and can optionally include alignment indicia 128. The portion 126 can include a cavity 127 (not visible in FIG. 1 or 2) that is open to the outside, preferably disposed so that it is hidden from view at address, such as by being disposed on the underside or side of the rearwardly extending portion 126. By including cavity 127, the portion 126 will be generally lightweight unless additional weight is added, and much of its mass with generally be at its periphery, which will tend to increase its MOI. The alignment line can be CNC milled or engraved in the top of the extending portion for precision.

Figure 2B:
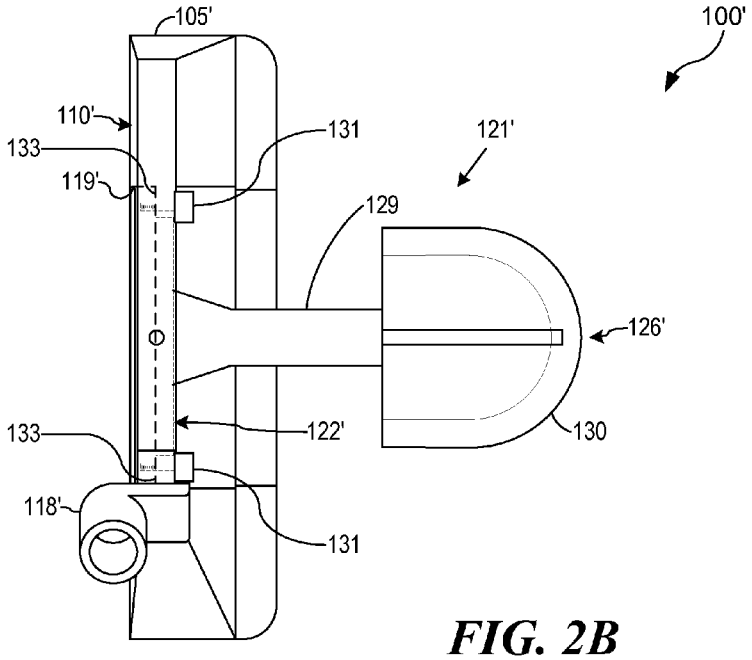
FIG. 2B illustrates a golf club putter head having a through-head insert, shown from the upper-rear of the head, that embodies features of the present invention; where the through-head insert includes a cylindrical rearwardly extending portion with a tongue-shaped end.

FIG. 2B illustrates a golf club head 100' that generally comprises a base head first portion 105', the main difference between this embodiment and the FIG. 1 and FIG. 2B embodiment being the shape of the rearwardly extending portion; i.e., in this embodiment it can have a generally cylindrical shape and includes an enlarged tongue-shaped end. The face portion 110' has an opening 119' through it, which opening 119' includes a through-head insert portion 121', which includes a front insert portion 122' that is preferably inserted with its striking face flush with the surrounding face 110', and can be at least partially retained in place by a press-fit or other interference fit, but at least in part or wholly by other securing means, such as threaded fasteners 131. In this embodiment, portion 126' can include a generally cylindrical shaped rearward extension 129 that extends behind the back of base head portion 105' and also can include an integral enlarged tongue-shaped end 130, which can also optionally include alignment indicia 128'. The rearwardly extending portion 126' can also include a cavity 127' (not visible in FIG. 2B) that is open to the outside, preferably disposed so that it is hidden from view at address, such as by being disposed on the underside or side of the rearwardly extending portion 126'. The alignment line can be CNC milled or engraved in the top of the for precision.

As can be seen in FIG. 2B, two threaded fasteners 131 extend into the back of the base head first portion 105' to secure the front insert portion 122' of through-head insert portion 121' onto the base head first portion 105' by compressing the wider flange portion of the front insert portion 122' against the shoulder 133 in the opening 119', by tightening the threaded fasteners 131.

Figure 3:
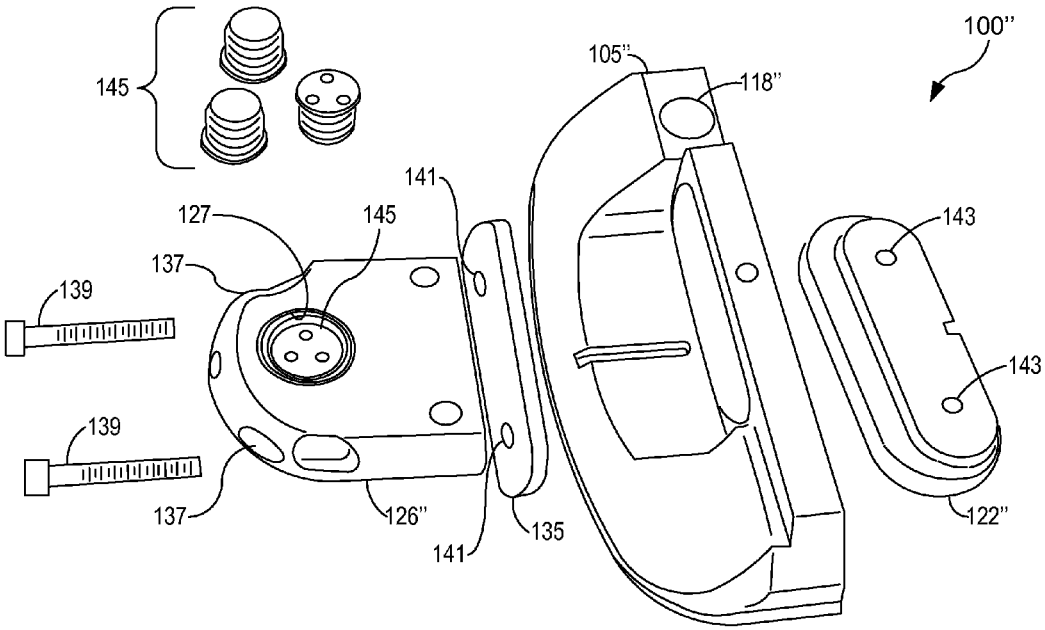
FIG. 3 illustrates an exploded view of a golf club putter head having a through-head insert, shown from the top of the head, that embodies features of the present invention; where the through-head insert has separable parts.

In another embodiment, illustrated in FIG. 3, shown as an exploded view, base head first portion 105" can have a somewhat different overall shape, and the through-head insert portion 121" can be comprised of readily separable parts. In this embodiment, golf club head 100" can comprise a base head first portion 105" having a somewhat different overall shape. The face portion 110" has an opening 119" through it, which opening 119" includes a through-head insert portion 121" comprised of several separable parts, including a front insert portion 122", bushing 135 and a rearwardly extending portion 126". Rearwardly extending portion 126" has two holes 137 extending through it that are sized to receive threaded fasteners 139. Threaded fasteners 139 also extend through holes 141 in bushing 135 and then into threaded holes 143 in the back of front insert portion 122". When assembled, threaded fasteners 139 are tightened, securing rearwardly extending portion 126" onto bushing 135, and bushing 135 onto the shoulder 133" of opening 119", and front insert portion 122" against the front side of shoulder 133" of opening 119", thus securely holding the through-head insert portion 121" together while also securing it to base head portion 105". It should be noted that rearwardly extending portion 126" is upside down in FIG. 3.

The head portion 105, 105', 105" etc. is not limited to the foregoing shapes, but can have a wide variety of shapes. These shapes can include, for example, the putter head shape of U.S. Design Pat. No. D430,633 to D. Billings, entitled "Putter Head", the entire contents of which are incorporated herein by reference.

The rearwardly extending portion 126" can also include a cavity 127" that is open to the outside, and configured to receive one or more of several different weights 145. Weights 145 can be configured in many different ways, including as lead tape or threaded members and can be secured in several different manners, including by means of adhesive or by means of threaded attachment, including the use of a set screw. In the embodiment shown in FIG. 3, the cavity is threaded, as are the weights. In FIG. 3, one of the weights 145 is showed threaded into and secured in cavity 127".

Other forms of attachment may also be used, alone or in concert with screws, such as locating pins or interference pins for a fixed assembly, or latches, straps or the like. Alternatively, or in addition, after fitting and selection, all parts can be epoxied together for an integral construction.

The stock material used to manufacture the base putter head portion can comprise 1.5-inch square bar stock of a 1018 Carbon Steel. This carbon steel can be milled with very clean and precise lines, provides longer tool life and also offers a very soft yet solid feel when struck with a golf ball in the finished club. Other metals, such as 12L14 Carbon Steel, 303 stainless steel, brass, bronze, copper, aluminum, aluminum bronze, titanium, magnesium, and other metals and metal alloys, however, may be used to achieve the desired shapes and performance effects.

A modular hosel can allow for a single traditional head style to be coupled with varying hosels for different shaft alignment configurations in the final product to suit different tastes and needs for specifications such as offset, face or toe balancing, in differing degrees, differing lie angles, all with the same basic head module. Alternatively, differing hosels may be obtained by milling, forging or casting them as one piece with the head, including the use of center shafted designs, with or without a hosel. Advantageously, various weight configurations and amounts can be employed to help optimize the balance of the head and location of center of percussion according to the hosel and/or shaft specifications, as these, along with the user's stroke mechanics, affect the dynamic location of the center of percussion.

In one embodiment, the metal billet of 1018 Carbon Steel is CNC machined, engraved, finished, polished, bead blasted, nickel plated, refinished and painted in the engraved areas, assembled with a hosel, a shaft and a grip, and can be offered for fitting or for sale to the end user with a selection of back portions of the rearwardly extending portion shapes, lengths and alignment indicia, and a selection of user-adjustable weights for selective placement within the cavity to optimize the putter's weight and performance for that particular user's needs, tastes and requirements, and changing course conditions. For instance, the user may alter the location of weights from high in the cavity to low in the cavity above the cover if he is playing slower greens, thus lowering the CG and providing a slightly higher launch and better roll on the slower grass.

Additionally, some golfers prefer a toe-up alignment of the putter head at address and throughout the stroke. However, such a position of the head actually moves the CG of the putter out of the manufacturer's intended geographically centered location. The optional weights can be placed in the lower toe side of the cavity to compensate for the toe-up orientation, and to re-center and optimize the CG to the proper location in relation to the face and alignment indicia.

As discussed above, the through-head insert 121, 121', 122", or portions thereof (such as the rearwardly extending portion 126, 126', 126") can be formed by a CNC milling method as described for the base head portion above, or some other suitable method, such as investment casting, forging, stamping, and/or the like. The through-head insert 121, 121', 122", or portions thereof (such as the rearwardly extending portion 126, 126', 126") could be formed all or in portions from of a type of composite or dense stiff plastic, such as Delrin®, supplied by Dupont®, which is known to be machinable easily and accurately, and yet is lighter than steel or aluminum, offering increased net discretionary weight adjustment.

In one embodiment, the through-head insert 121, 121', 122", or portions thereof (such as the rearwardly extending portion 126, 126', 126") can be machined from a 6061 Aerospace grade aluminum alloy, while the bottom portion of the rearwardly extending portion 126, 126' and 126" can be CNC milled or injection molded from Delrin®, while the putter head body portion 210 is CNC milled from 1018 Carbon steel or alternatively a 303 Stainless Steel. The aluminum alloy portion of the through-head insert, or portions therefore, is then finished, and either painted, powder-coated, anodized or plated. The metal portions can be either bead blasted and clear anodized, or white powder coated to provide increased alignment optics. The Delrin® lower rearwardly extending portion can then be fastened together with the upper alloy portion of the rearwardly extending portion with screws to form one unit The alloy portion of the portion 126, 126' and 126" can be plated with an electroless Nickel plating, also known as e-Nickel, as is the carbon steel head portion, to reduce corrosion and oxidation of the alloy and mild steel surfaces and to provide a homogenous look, to further enhance the traditional look and appeal of the putter.

Figure 4A:
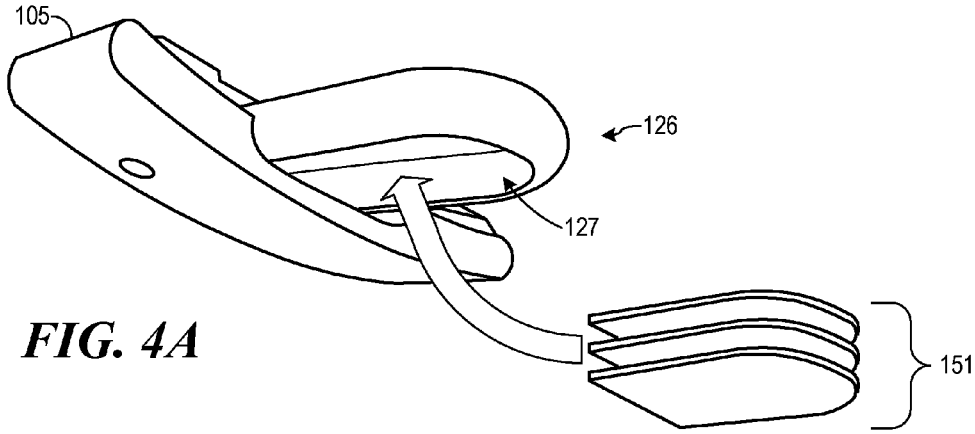
FIG. 4A illustrates the attachment of weight in a cavity in the underside of the rearwardly extending portion in accordance with one embodiment of the present invention.

FIG. 4A illustrates an embodiment of the invention from the underside, to show cavity 127 and with a selectable plurality of optional die-cut lead weight strips 151 that can be disposed in cavity 127, fitting flush inside the cavity 127 in the bottom of the rearwardly extending portion 126.

Figure 4B:
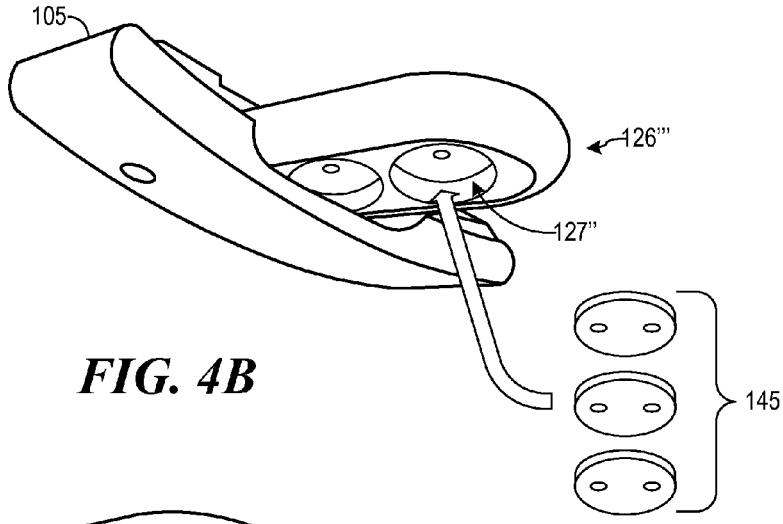
FIG. 4B illustrates the attachment of a selection of weights in a cylindrical blind bore in accordance with one embodiment of the present invention.

FIG. 4B illustrates an embodiment where weights 145 are threaded to fit securely into a bored and tapped cavity 127" in the rearwardly extending portion 126", with a selection of optional weights shown.

Figure 4C:
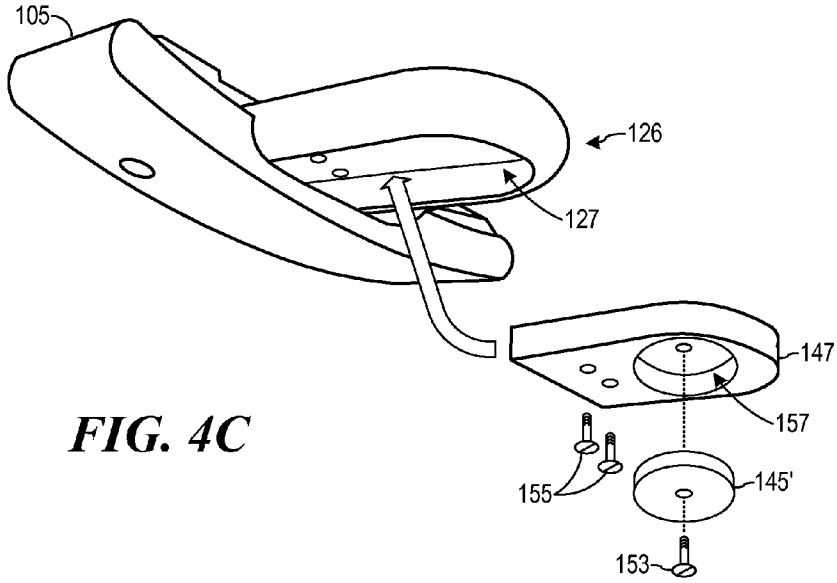
FIG. 4C illustrates the attachment of a selection of weight cartridges in a cavity in the underside of the rearwardly extending portion in accordance with one embodiment of the present invention.

FIG. 4C illustrates an embodiment having a rearwardly extending portion 126''', that can be milled from Delrin® and having a cavity 127'''. A cavity cover 147 including a cavity 157 and including optional weights 145' from a selection of weights can be secured into cavity 157 of cavity cover 147 with a screw 153, in order to customize the back-weighting and balance of the putter. The cavity cover 147 is then secured with screws 155 to cavity 127 of the portion 126''' to cover the cavity 127'''. Weighting materials can be comprised of dense materials, such as lead, brass, copper, steel, tungsten, silver or gold, or any other heavy metal or other heavy materials. These optional weight materials can be made to fill the entire cavity, or can be secured to the peripheral walls of the cavity, as taught in U.S. Pat. No. 7,004,852 to Billings, fully incorporated herein by reference. Although the putter head of this current invention is not substantially hollow, the cavity of the rearwardly extending portion can be, and therefore adjustment of weights inside this cavity can be used to adjust the CG and Center of Percussion (CP) of the putter head to optimize the CP to the CG for various golfer's stroke mechanics, positively optimizing launch and roll performance.

Figure 5:
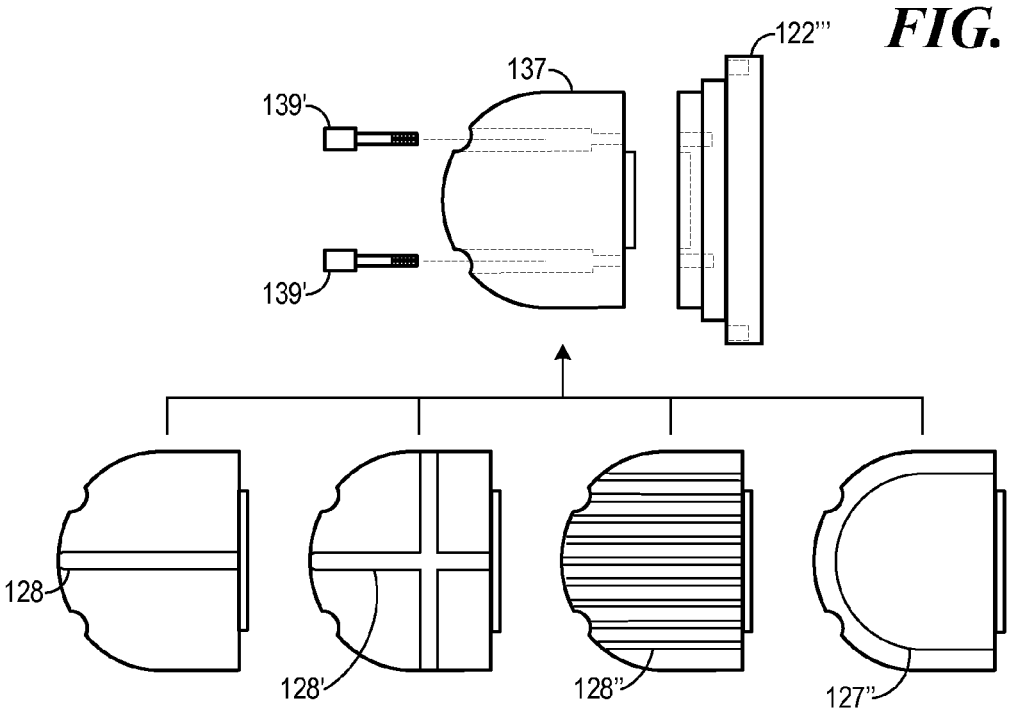
FIG. 5 illustrates a top view of the through-head insert components, with a series of selectable rearwardly extending portion tongue alignment indicia selectable for fitting or end-user requirements and tastes.

FIG. 5 illustrates an embodiment having a through-head insert having a separable front insert portion and a selectable plurality of optional rearwardly extending portion configures with various alignment indicia applied to the top portion of the. In another embodiment, a small pocket is milled into the top of the rearwardly extending portion, in order to receive a set of optional alignment decals or emblems, with various alignment indicia imprinted thereon or therein. The joint between the front striking face of through-head insert and the selectable rearwardly extending portion can be hidden from the golfer's view at address by the overhanging top-line, so it can appear as one continuous piece.

Figure 6:
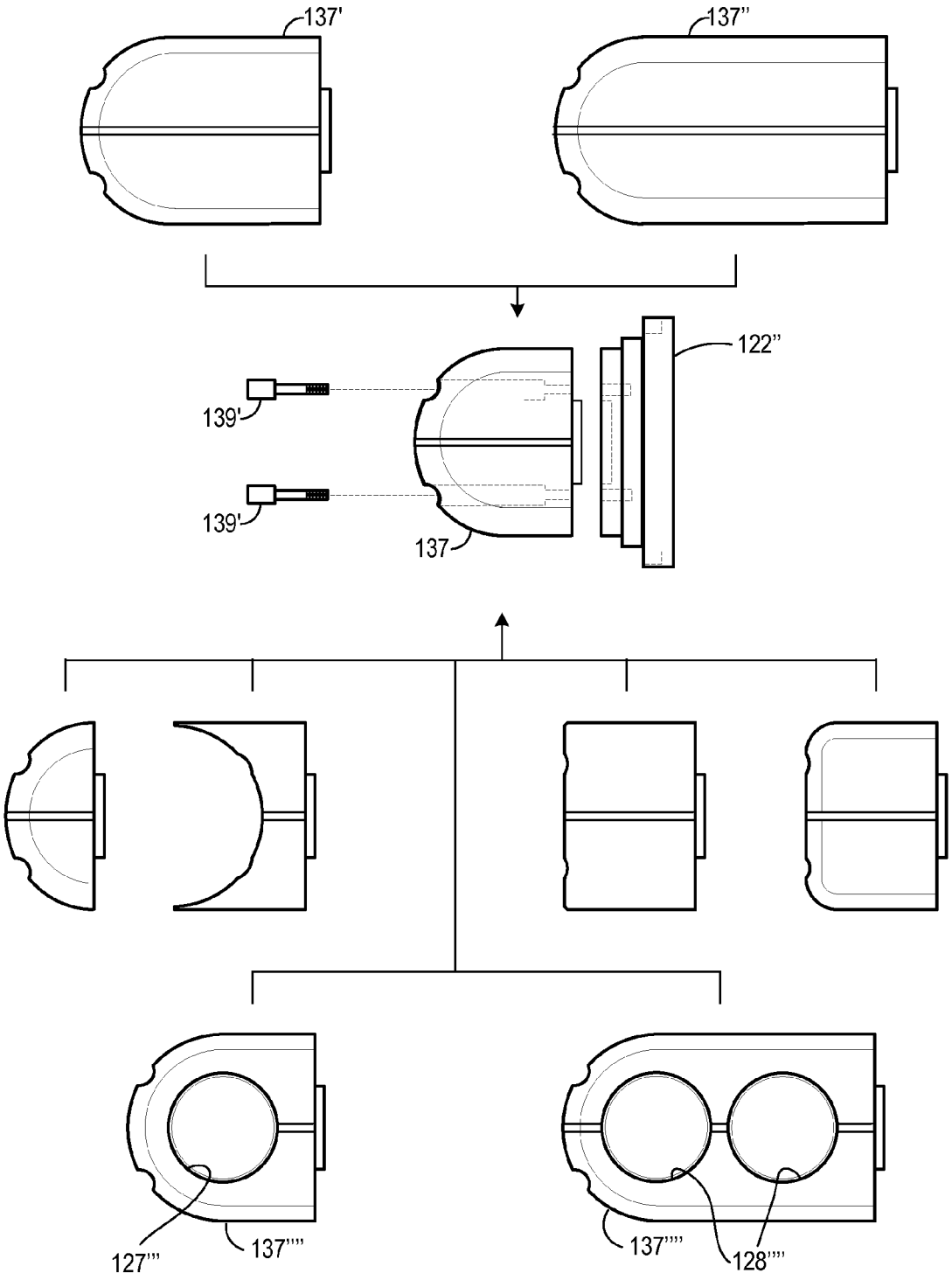
FIG. 6 illustrates a top view of the through-head insert components, including rearwardly extending portion tongues of various lengths, and various shapes, to be affixed to the head.

FIG. 6 illustrates another embodiment with a selectable plurality of rearwardly extending portion with a selection of lengths, and shapes, using screws that attach the rearwardly extending portion to the through-head insert from the rear. Shorter or longer rearwardly extending portions can therefore be selected to suit an individual golfer's needs and desires, as can the shape of the rearwardly extending portion. The screws can be used to switch out the rearwardly extending portion if the golfer so desires, so long as it is not during a competitive round. Weight adjustments inside the rearwardly extending portion cavity can be made to compensate for the exact preferred net weight. For instance, a heavier weight can be used in a smaller, lighter rearwardly extending portion, or vise versa, or a heavier weight can be used in a heavier rearwardly extending portion for an overall heavier weight and more back-weight balance. The connecting screws can be affixed using a common allen-type hex wrench, or other special wrench, such as one that also holds additional optional weights. The screws can also be conventional screws, if permitted by the rules. The screws can also be epoxied in place for a more permanent construction, as previously described. Alternatively, the screws can be inserted and secured from the face side, preferably counter-sunk and flush mounted outside the center effective hitting area, and as long as they adhere to known rules regulating the face screws.

Figure 7:
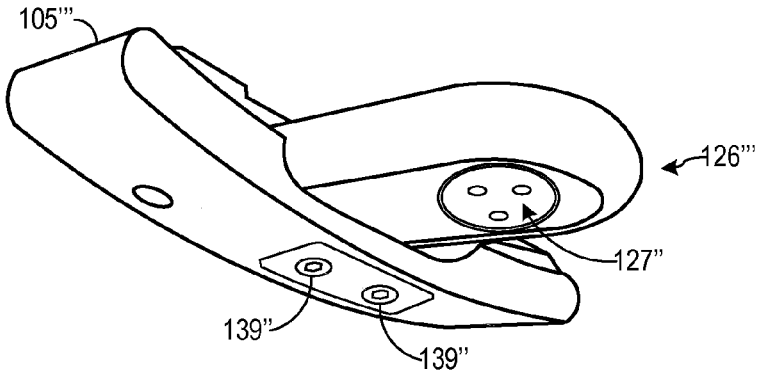
FIG. 7 illustrates a bottom-rear view of one embodiment of the present invention in which the rearwardly extending portion has a round cavity for receiving a weight, and where there are threaded screws at the sole of the club head to secure the rearwardly extending portion in place.

FIG. 7 illustrates a bottom-rear view of one embodiment of the present invention in which the rearwardly extending portion has a round cavity for receiving a weight, and where there are threaded screws at the sole of the club head to secure the rearwardly extending portion in place Accordingly, the traditional design host may be selected among any design thought by golfers to be traditional and as desired by the golf club designer, pro or club fitter to obtain the desired weighting characteristics without departing from the spirit of the present invention. The style of the head, whether it be a flange blade, flange cavity backed blade, flange half mallet, small mallet or any previous style where the center of gravity was relatively low in the head and near the striking face, can be altered, improved and made suitable for a wide variety of golfer's stroke mechanics and other fitting specifications, while providing optimal forgiveness and roll characteristics for today's various green types and speeds by applying the concepts of the present invention.

The total weight of the putter head can be approximately 250 to 300 grams without the hosel. In this manner, the lightest playing weight can be achieved with the weight cavity or cavities empty, which may be best balanced for some golfers, including those with longer and/or heavier shafts, for instance. Those requiring heavier heads and more back-weighting can then add weight according to their needs and preference. Advantageously, the large cavity of the rearwardly extending portion can accept 150 grams of additional weight or more, also making these heads ideal for belly and even long putters, where such weight is desirable.

Preferably, the CNC milling process described above allows for a high quality, traditional looking and feeling putter to be produced. Various other weighted heads, by thickening or thinning various portions, may produce different weight putters for different golfers tastes, or for shorter or longer length putters as described. Alternatively, additional denser weighting material, such as tungsten, and the like, may be added to further modify the weight, moment of inertia, center-of-gravity and/or center of percussion location as desired.

As will be appreciated by one skilled in the art, the size and shape of the insert and the rearwardly extending portion may differ between various shapes and head designs. For instance, the outline of the face insert portion could be a square, a circle, a rounded square, a rectangle, a rounded rectangle, trapezoid or other shape. Likewise, the shape of the rearwardly extending portion can be made of many shapes without departing from the spirit or scope of the invention. Additionally, the materials used for the base putter and tongue can be the same as one another, or different.

For example, the striking face can be smooth, rough or have grooves therein. In one embodiment, the striking face can include a plurality of arcuate grooves. These grooves can include spaced-apart opposed intersecting arcuate grooves. In another embodiment, these spaced-apart opposed intersecting arcuate grooves can be vertically spaced apart with the putter head positioned at address.

Figure 8:
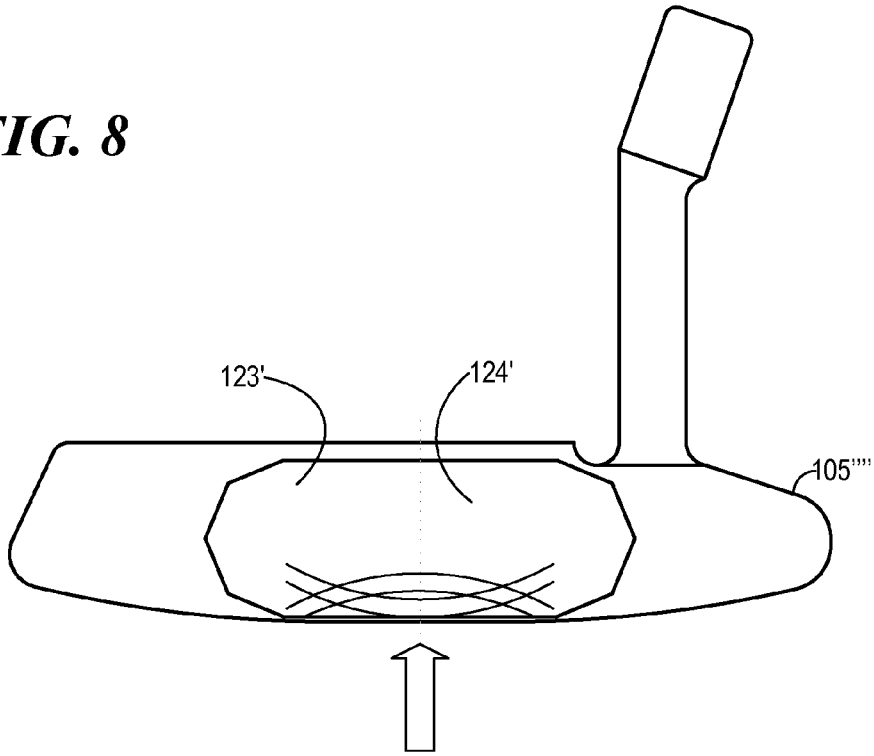
FIG. 8 illustrates a view of one embodiment of a face pattern of a putter head that embodies the present invention.

FIG. 8 illustrates a view of one embodiment of a face pattern of a putter head that embodies such grooves.

FIG. 9 illustrates a view of the face of a putter head that embodies the present invention, with two spaced-apart leading edge arcuate grooves and two intersecting spaced-apart trailing edge arcuate grooves.

FIG. 10A is a vertical cross section through the face nearer the heel or toe of a vertically milled face that embodies the present invention, showing one example of the leading and trailing edge grooves as they would appear nearer the heel or toe of the face mill pattern, where the grooves are spaced closer together than the grooves in the middle of the face.

FIG. 10B is a vertical cross section through the middle of the face of a vertically milled face that embodies the present invention, showing one example of the leading and trailing edge grooves as they would appear in the middle of the face.

By milling the pattern in this manner, preferably with a small overlapping section, the pattern is framed visually for enhanced optics for aligning the putter at address, and throughout the stroke. Milling the grooves in the face in this manner also provides an immediate overspin being placed on the golf ball when struck with the club in its intended manner, that is, when swung normally by the golfer. The grooves also reduce the surface area contacting the ball at impact, and thus soften and improve the feel transmitted to the golfer. Furthermore, as the pattern changes outward from the center of the pattern, a different impact characteristic and different sound and feel is transmitted to the golfer on miss-hits, increasing the responsiveness and feedback important for the golfer to adjust and improve his or her stroke.

It is understood that the present invention can take many forms and embodiments. Accordingly, several variations may be made in the foregoing without departing from the spirit or the scope of the invention. For example, the traditional design may consist of other kinds of head styles of putters, such as flange blades with no cavities, heel shafted flange blades, mallets with and without cavities, putters with or without hosels, center shafted putters, mid-length or belly putters, long putters, and the like.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A golf club head assembly, comprising, in combination:

a first discrete, user-interchangeable weight portion;

a second discrete, user-interchangeable weight portion having a different weight profile as compared to the first user-interchangeable weight portion;

a body adapted to receive and retain accessibly and detachably one of: the first user-interchangeable weight portion, and the second user-interchangeable weight portion; and a modular hosel having one of different shaft alignment configurations coupled to the body to form one of differing lie angles;

the first user-interchangeable weight portion when received and retained accessibly and detachably in the body presenting a first center of gravity relative to the body to which it is received and retained accessibly and detachably;

the second user-interchangeable weight portion when received and retained accessibly and detachably in the body presenting a second center of gravity relative to the body to which it is received and retained accessibly and detachably, the second center of gravity different from the first center of gravity;

where the differing lie angle of the modular hosel and a weight configuration provided by the received and retained user-interchangeable weight portion alters a balance of the body and location of a center of percussion.

2. The golf club head assembly as described in claim 1 wherein a center of gravity of the body has a first location when the first user-interchangeable weight portion is received and retained accessibly and detachably in association with the body, and a second location when the second user-interchangeable weight portion is received and retained accessibly and detachably in association with the body.

3. The golf club head assembly as described in claim 1 wherein the first user-interchangeable weight portion is formed of a material having a density that differs from a density of a material of the second user-interchangeable weight portion.

4. The golf club head assembly as described in claim 1 wherein the body is associated with a putter type club head.

5. The golf club head assembly as described in claim 1 wherein the body is associated with an iron type club head.

6. The golf club head assembly as described in claim 1 wherein the body is associated with a wood type club head.

7. The golf club head assembly as described in claim 1 wherein at least one of the first and second discrete, interchangeable weight portions includes at least one user-adjustable attached weight, the user-adjustable weight and its attachment hidden from the user upon address.

8. The golf club head assembly as described in claim 1 wherein each of the first and second user-interchangeable weight portions includes an alignment marking, and the alignment marking of the first user-interchangeable weight portion differs from the alignment marking of the second user-interchangeable weight portion.

9. The golf club head assembly as described in claim 1 wherein at least one of the first and second user-interchangeable weight portions includes discrete user-adjustable weights located in an underside of the weight portion.

10. The golf club head assembly as described in claim 1 wherein at least one of the first and second user-interchangeable weight portions is received in a cavity in a rear portion of the body distinct from a ball-striking face portion.

11. The golf club head assembly as described in claim 1 wherein at least one of the first and second user-interchangeable weight portions is received in a cavity in an underside of the body distinct from a ball-striking face portion.

12. The golf club assembly as described in claim 1 wherein the first user-interchangeable weight portion has a characteristic that differs from the characteristic of the second user-interchangeable weight portion, the characteristic being one of: shape, length, size, and alignment marking.

* * * * *